US008245896B2

(12) United States Patent
Gschwend et al.

(10) Patent No.: US 8,245,896 B2
(45) Date of Patent: Aug. 21, 2012

(54) HAND-OPERATED DRIVE-IN POWER TOOL

(75) Inventors: Hans Gschwend, Buchs (CH); Robert Spasov, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 55 days.

(21) Appl. No.: 12/706,917

(22) Filed: Feb. 17, 2010

(65) Prior Publication Data

US 2010/0206592 A1 Aug. 19, 2010

(30) Foreign Application Priority Data

Feb. 18, 2009 (DE) ..... 10 2009 000 957

(51) Int. Cl.
*B25D 17/00* (2006.01)

(52) U.S. Cl. ..... 227/131; 227/134; 227/156; 337/123; 337/139; 337/140; 337/382; 337/393; 337/394; 337/395; 267/89; 267/69; 267/73

(58) Field of Classification Search ..... 227/131, 227/134, 156; 337/123, 139, 140, 382, 393, 337/394–395; 267/89, 69, 73
See application file for complete search history.

(56) References Cited

U.S. PATENT DOCUMENTS

| | | | | |
|---|---|---|---|---|
| 3,513,429 | A * | 5/1970 | Helsop | 337/382 |
| 4,218,888 | A * | 8/1980 | Jayne | 60/632 |
| 4,559,512 | A * | 12/1985 | Yaeger et al. | 337/140 |
| 5,511,715 | A * | 4/1996 | Crutcher et al. | 227/131 |
| 6,447,478 | B1 * | 9/2002 | Maynard | 604/95.05 |
| 7,764,159 | B2 * | 7/2010 | Zanella et al. | 337/140 |
| 2006/0148296 | A1 * | 7/2006 | Zanella et al. | 439/310 |

FOREIGN PATENT DOCUMENTS

DE 10 2006 000 202 A1 11/2007

* cited by examiner

*Primary Examiner* — Brian D Nash
*Assistant Examiner* — Michelle Lopez
(74) *Attorney, Agent, or Firm* — Crowell & Moring LLP

(57) ABSTRACT

A hand-operated drive-in power tool for fastening elements is disclosed. The tool has a drive arrangement for a drive-in ram displaceably arranged in a guide, which has at least one drive element for the drive-in ram made at least partially of an elastomer that is tensible via a tensioning device. To improve the drive-in power tool, a heating device for the at least one elastomer drive element is provided.

7 Claims, 2 Drawing Sheets

HAND-OPERATED DRIVE-IN POWER TOOL

This application claims the priority of German Patent Document No. 10 2009 000 957.4, filed Feb. 18, 2009, the disclosure of which is expressly incorporated by reference herein.

BACKGROUND AND SUMMARY OF THE INVENTION

The present invention relates to a hand-operated drive-in power tool. These types of hand-operated drive-in power tools have a displaceably guided drive-in ram which can be used to drive the fastening elements into a substrate.

A generic drive-in power tool is known from German Patent Document No. DE 10 2006 000 202 A1. This drive-in power tool has a drive arrangement for a drive-in ram displaceably arranged in a guide, which has at least one drive element for the drive-in ram formed as an elastomer band that is tensible via a tensioning device. The tensioning device in this case includes an electric drive.

Because of the lower density of the elastomer band as compared, for example, to a steel spring and because of the longer acceleration path, greater drive-in speeds can be achieved with this drive-in power tool and thus greater drive-in energy. However, a known disadvantage of elastomer materials is its diminishing efficiency at low temperatures.

The object of the present invention is to improve a drive-in power tool of the foregoing type and also to guarantee a high drive-in energy at low temperatures.

According to the present invention, a heating device is provided in the drive-in power tool for the at least one elastomer drive element. The, or each, elastomer drive element at low temperatures, i.e., at temperatures less than 10° C. for example, can be brought via the heating device to a favorable operating temperature, e.g., within a range of approx. 10° to approx. 50° C., thereby guaranteeing optimum efficiency of the elastomer drive elements and thus a high drive-in energy even at low temperatures. At least one temperature sensor is advantageously provided for determining the device temperature, thereby enabling automatic switch-on of the heating device as a function of the measuring data from the temperature sensor.

Furthermore, it is advantageous if the at least one temperature sensor is connected to a control unit, via which the heating device is controllable, thereby making automatic control of the heating device possible in a simple manner.

Moreover, it is advantageous if the heating device has a number of heating elements corresponding to the number of elastomer drive elements, thereby making a uniform heating of the elastomer drive elements possible.

In addition, it is advantageous if the, or each, heating element is arranged adjacent to an associated elastomer drive element and running along its longitudinal extension, which makes it possible for the applied thermal energy to be used especially efficiently.

Furthermore, it can be advantageous if the heat radiation of the, or each, heating element is focused in the direction of the associated drive element, thereby further optimizing the use of energy.

Alternatively, the heating device could also use the waste heat from the sources of heat present in the drive-in power tool, such as, for example, a tensioning motor or power electronics. Furthermore, the heating device could also be designed such that it puts the, or each, elastomer drive element into an oscillating movement with low expansion of the drive element, thereby producing heating of the, or each, drive element through internal friction.

The invention is depicted in the drawings in an exemplary embodiment.

DETAILED DESCRIPTION OF THE DRAWINGS

Figure 1:
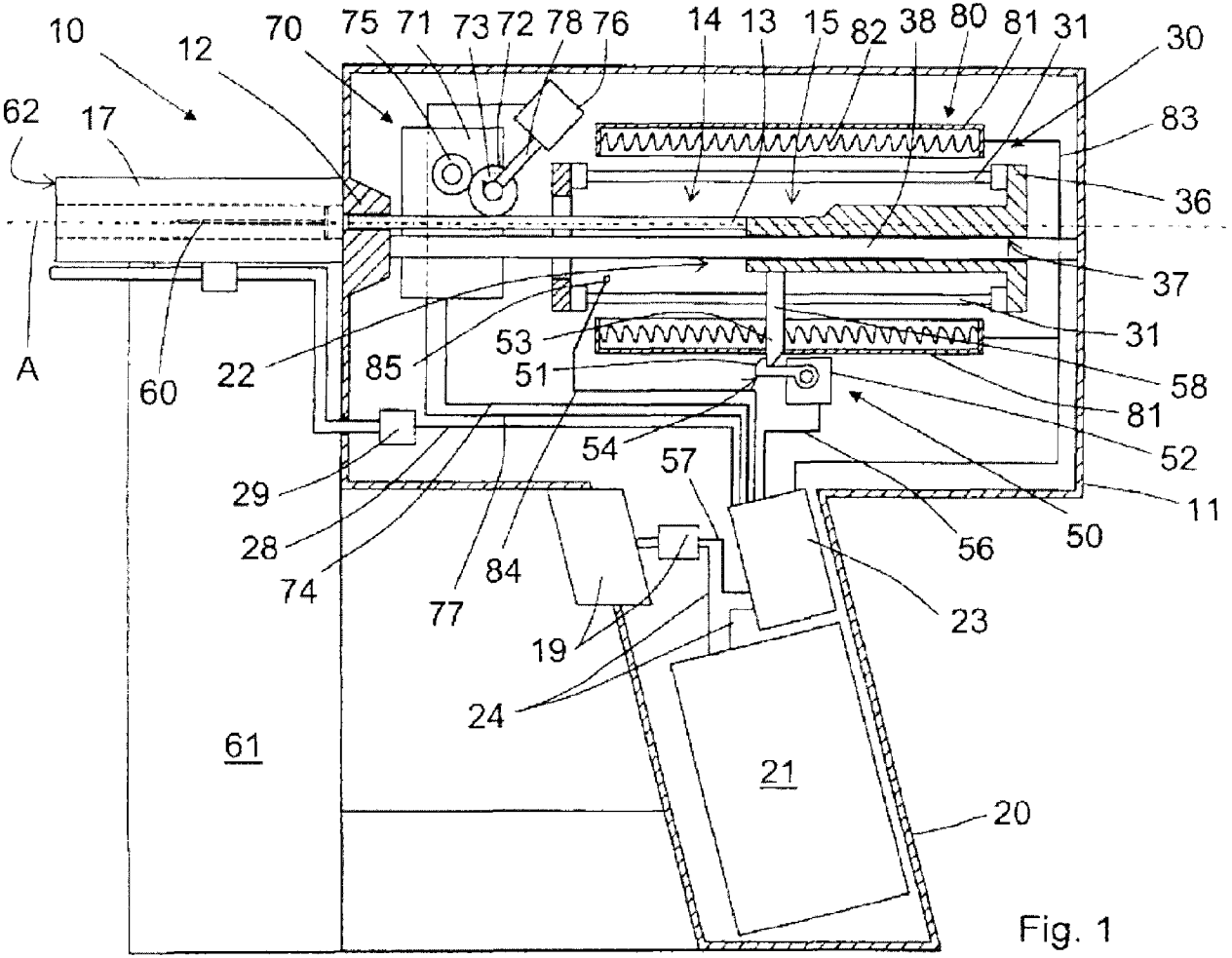
FIG. 1 is a longitudinal section of a drive-in power tool according to the invention in its initial position.
Figure 2:
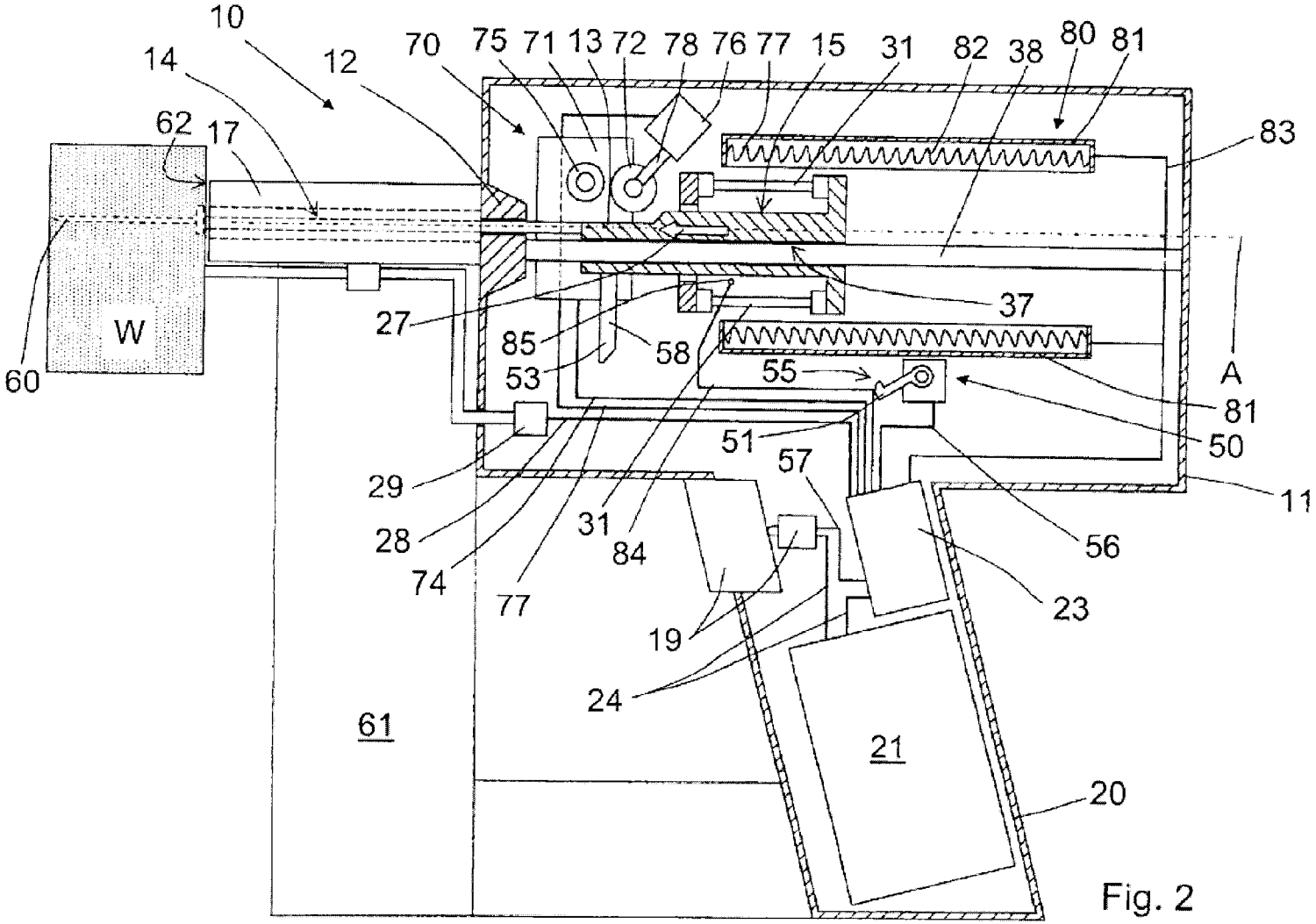
FIG. 2 illustrates the drive-in power tool from FIG. 1 in an actuated position.

The drive-in power tool 10 depicted in FIGS. 1 and 2 features a housing 11 and a drive arrangement for a drive-in ram 13 arranged in the housing and designated as a whole by 30. The drive-in ram 13 in this case has a drive-in section 14 for a fastening element 60 and a head section 15. The drive-in section 14 is guided displaceably into a guide 12, while the head section 15 has a guide channel 37, via which the head section 15 is displaceably guided on a guide rod 38.

At the end of the guide 12 lying in the drive-in direction 27 (see FIG. 2) is a bolt guide 17 adjoining the guide and running coaxially thereto. A fastening element magazine 61, in which the fastening elements 60 are stored, projects laterally from the bolt guide 17.

The drive arrangement 30 includes elastomer drive elements 31 formed as elastomer bands, which are arranged with one end on a housing-mounted support element 36 and with another end on the head section 15 of the drive-in ram 13.

Furthermore, the drive-in power tool 10 also features a heating device for the elastomer drive elements 31 designed as whole as 80. The heating device 80 depicted in the exemplary embodiment includes two heating elements 81, each of which is associated with a respective elastomer drive element 31. The heating elements 81, which have heating wires 82 as sources of heat, are arranged adjacent and parallel to the longitudinal extension of the elastomer drive elements 31 running within the housing 11. The heat radiation from the heating elements 81 is always focused in the direction of the associated drive element 31. The heating elements 81 are connected electrically to a control unit 23 via a supply line 83. In addition, a temperature sensor 85 is also arranged in the drive-in power tool, which is connected to the control unit 23 via a sensor line 84. Operation of the heating device 80 with the two heating elements 81 with respect to switch on/off times and operating duration is controlled via the control unit 23 as a function of the temperature measured by the temperature sensor 85.

In the initial position 22 of the drive-in ram 13 shown in FIG. 1, the drive-in ram is elastically pretensioned by the elastomer drive elements 31, and the free end of its head section 15 lies in a rearward area of the housing 11 facing away from the bolt guide.

In the initial position 22, the drive-in ram 13 is held by a locking device designated as a whole by 50, which has a pawl 51, which engages in a locking position 54 (see FIG. 1) on a locking surface 53 on a projection 58 of the drive-in ram 13 and holds it against the force of the elastomer drive elements 31. The pawl 51 is supported on an adjusting motor 52 and can be transferred by the adjusting motor to a release position 55 (shown in FIG. 2), as will be described in the following. The adjusting motor 52 is connected to the control unit 23, which also controls the heating device 80, via a first electric control line 56.

Furthermore, the drive-in power tool 10 also has a handle 20, on which an actuation switch 19 for actuating a drive-in process with the drive-in power tool 10 is arranged. A power supply designated as a whole by 21, which supplies the drive-in power tool 10 with electrical energy, is further arranged in the handle 20. The power supply 21 here includes at least one accumulator. The power supply 21 is connected to the control unit 23 as well as to the actuation switch 19 via electrical supply lines 24. The control unit 23 here is further connected to the actuation switch 19 via a switch line 57.

Arranged at a mouth 62 of the drive-in power tool 10 is a switching means 29, which is connected electrically to the control unit 23 via a switching means line 28. The switching means 29 transmits an electrical signal to the control unit 23 as soon as the drive-in power tool 10 is pressed against a workpiece W, as shown in FIG. 2, and thus ensures that the drive-in power tool 10 can only be actuated if it is pressed properly against a workpiece W.

Moreover, a tensioning device designated as a whole by 70 is arranged on the drive-in power tool 10. This tensioning device 70 includes an electric drive motor 71 via which a drive roller 72 can be driven. The electric drive motor 71 is connected electrically to the control unit 23 via a second control line 74 and can be put into operation via the control unit, for example, if the drive-in ram 13 is in its end position lying in the drive-in direction 27 or if the drive-in power tool 10 is lifted up from the workpiece W again. The electric drive motor 71 has an output means 75, such as a driven gear, which can be coupled to the drive roller 72. To this end, the drive roller 72 is positioned rotatably on a longitudinally adjustable adjusting arm 78 of an adjusting means 76 embodied as a solenoid. In this case, the adjusting means 76 is connected to the control unit 23 via an adjusting means line 77. During operation, the drive roller 72 rotates in the direction of the arrow 73 indicated by a dashed line.

If the drive-in power tool 10 is put into operation by a main switch (not shown here), the control unit 23 determines first of all as a function of the temperature determined by the drive-in power tool's temperature sensor whether the heating device must be put into operation and how long this heating operation must be carried out. If required, the heating device 80 is then switched on by the control unit 23 in order to bring the elastomer drive elements 31 to an optimum operating temperature, e.g., in a range of approx. 10° to approx. 50° C.

Furthermore, the control unit 23 makes sure that the drive-in ram 13 is in its initial position 22 as shown in FIG. 1. If this is not the case, then the drive roller 72 is moved by the adjusting means 76 towards the output means 75, which has already been set into rotation by the electric drive motor 71, and coupled therewith. At the same time, the drive roller 72 engages the drive-in ram 13 so that the same is displaced in the direction of its movement axis A via the drive roller 72 rotating in the direction of the arrow 73 with its head portion 15 further away from the bolt guide 17 into the housing 11. In the process, the elastomer drive elements 31 of the drive arrangement 30 are tensioned. If the drive-in ram 13 reaches its initial position 22, then the pawl 51 of the locking device 50 engages in the locking surface 53 on the drive-in ram 13 and holds the same in the initial position 22 against the tensile force of the elastomer drive elements 31. The electric drive motor 71 can then be switched off via the control unit 23 and the adjusting means 76, likewise controlled by the control unit 23, moves the drive roller 72 from its engaged positioned on the output means 75 and on the drive-in ram 13 into its disengaged position (see FIG. 2).

If the drive-in power tool 10 is pressed against a workpiece W, as depicted in FIG. 2, then first of all the control unit 23 is put into drive-in readiness via the switching means 29. If the actuation switch 19 is then actuated by an operator, the locking device 50 is displaced into its release position 55 via the control unit 23, wherein the pawl 51 is lifted off the locking surface 53 on the drive-in ram 13 via the adjusting motor 52. The pawl 51 can then be spring-loaded in the direction of the drive-in ram 13.

The drive-in ram 13 is then moved in the drive-in direction 27 via the elastomer drive elements 31 of the drive arrangement 30, thereby driving a fastening element 60 into the workpiece W.

To return the drive-in ram 13 and to tension the elastomer drive elements 31, the tensioning device 70 is activated by the control unit 23 at the end of a drive-in process when the drive-in power tool 10 is lifted up from the workpiece W again. The switching means 29 supplies a signal to the control unit 23 for this purpose. Through the tensioning device 70, the drive-in ram 13 is displaced in the manner already described against the elastomer drive elements 31 of drive arrangement 30 and the elastomer drive elements 31 are re-tensioned in the process until the pawl 51 can again engage in its locking position 54 on the locking surface 53 on the drive-in ram 13.

Temporarily holding the drive-in ram 13 via the locking device 70 makes sure that the elastomer drive elements 31, that may possibly begin to oscillate during the tensioning process, can settle down before a new drive-in process.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A hand-operated drive-in power tool for fastening elements, comprising:

a drive arrangement for a drive-in ram displaceably arranged in a guide, wherein the drive arrangement has at least one drive element for the drive-in ram made at least partially of an elastomer that is tensible via a tensioning device; and a heating device for the at least one elastomer drive element;

wherein the heating device is arranged adjacent to the at least one elastomer drive element and runs along a longitudinal extension of the at least one elastomer drive element.

2. The drive-in power tool according to claim 1, further comprising a temperature sensor for determining a temperature of the heating device.

3. The drive-in power tool according to claim 2, further comprising a control unit, wherein the temperature sensor is connected to the control unit, and wherein the heating device is controllable by the control unit.

4. The drive-in power tool according to claim 1, wherein the heating device has a number of heating elements corresponding to a number of elastomer drive elements.

5. The drive-in power tool according to claim 4, wherein the heating elements are arranged adjacent to associated elastomer drive elements and run along a longitudinal extension of the elastomer drive elements.

6. The drive-in power tool according to claim 5, wherein a heat radiation of the heating elements is focused in a direction of the associated drive elements.

7. A hand-operated drive-in power tool, comprising:

a drive arrangement including:

a drive-in ram;

an elastomer drive element coupled to the drive-in ram; and a heating device associated with the elastomer drive element, wherein the heating device is arranged adjacent to the elastomer drive element and runs along a longitudinal extension of the elastomer drive element.

* * * * *